US008774701B2

(12) United States Patent
Uehara

(10) Patent No.: US 8,774,701 B2
(45) Date of Patent: Jul. 8, 2014

(54) IMAGE FORMING APPARATUS WITH REDUCED HEIGHT

(75) Inventor: Junji Uehara, Inazawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 220 days.

(21) Appl. No.: 13/035,138

(22) Filed: Feb. 25, 2011

(65) Prior Publication Data

US 2011/0236101 A1 Sep. 29, 2011

(30) Foreign Application Priority Data

Mar. 23, 2010 (JP) ..... 2010-066694

(51) Int. Cl.
*G03G 15/00* (2006.01)
*G03G 15/23* (2006.01)

(52) U.S. Cl.
CPC .... *G03G 15/232* (2013.01); *G03G 2215/00586* (2013.01); *G05G 2215/0043* (2013.01); *G03G 15/6558* (2013.01); *G03G 15/657* (2013.01)
USPC ..... 399/401; 399/388; 399/397; 399/390

(58) Field of Classification Search
USPC ..... 399/390, 388, 397, 401; 271/208
See application file for complete search history.

(56) References Cited

U.S. PATENT DOCUMENTS 6,618,577 B2 9/2003 Omura
7,460,813 B2 * 12/2008 Kuwata et al. ..... 399/110
7,664,425 B2 * 2/2010 Tsusaka ..... 399/107
7,680,449 B2 3/2010 Shimizu
2002/0127038 A1 9/2002 Omura
2004/0022567 A1 * 2/2004 Fukatsu et al. ..... 399/405

(Continued)

FOREIGN PATENT DOCUMENTS

JP 05188805 A * 7/1993
JP H10-142959 A 5/1998

(Continued)

OTHER PUBLICATIONS

Machine translation of JP 2002-265093 A Author/inventor: Omura Date: Sep. 18, 2002.*

(Continued)

*Primary Examiner* — Matthew G Marini
*Assistant Examiner* — John M Royston
(74) *Attorney, Agent, or Firm* — Banner & Witcoff, Ltd.

(57) ABSTRACT

There is provided an image forming apparatus including a transferring unit, fixing unit, a first sheet conveying path section, a re-conveying unit and a charge-removing member. The transferring unit transfers developer onto a sheet. The fixing unit fixes the developer transferred to the sheet to form a visible image on the sheet. The first sheet conveying path section extends through the transfer unit and the fixing unit, the sheet being conveyed from the transfer unit to the fixing unit along the first sheet conveying path section. The re-conveying unit constitutes a second sheet conveying path section for re-conveying the sheet from the fixing unit to an inlet side of the transfer unit, the second sheet conveying path section being positioned below the first sheet conveying path section. The charge-removing member is disposed between the first sheet conveying path section and the second sheet conveying path section, the charge-removing member constituting a part of the second sheet conveying path section and removing charges from the sheet conveyed along the first sheet conveying path section.

9 Claims, 10 Drawing Sheets

(56) References Cited

U.S. PATENT DOCUMENTS

| | | | | |
|---|---|---|---|---|
| 2005/0105953 | A1 | 5/2005 | Katayama et al. | |
| 2005/0220479 | A1 | 10/2005 | Ito et al. | |
| 2005/0220494 | A1 | 10/2005 | Kato et al. | |
| 2005/0220517 | A1 | 10/2005 | Matsushima et al. | |
| 2005/0221907 | A1 | 10/2005 | Kato et al. | |
| 2007/0147920 | A1 * | 6/2007 | Shimizu | 399/400 |
| 2009/0097894 | A1 | 4/2009 | Ito et al. | |
| 2009/0252521 | A1 * | 10/2009 | Takami | 399/69 |

FOREIGN PATENT DOCUMENTS

| | | | |
|---|---|---|---|
| JP | H10-161374 | A | 6/1998 |
| JP | H10-167583 | A | 6/1998 |
| JP | 2000-231227 | | 8/2000 |
| JP | 2000-296970 | | 10/2000 |
| JP | 2001-318496 | A | 11/2001 |
| JP | 2002-020043 | | 1/2002 |
| JP | 2002-265093 | A | 9/2002 |
| JP | 2002-302293 | | 10/2002 |
| JP | 2005-041610 | A | 2/2005 |
| JP | 2005-292356 | | 10/2005 |
| JP | 2007-176611 | A | 7/2007 |
| JP | 2007-264169 | A | 10/2007 |
| JP | 2007264169 | A * | 10/2007 |

OTHER PUBLICATIONS

JP Office Action mailed Feb. 14, 2012, JP Appln. 2010-066694, English translation.

* cited by examiner

IMAGE FORMING APPARATUS WITH REDUCED HEIGHT

CROSS REFERENCE TO RELATED APPLICATION

This application claims priority from Japanese Patent Application No. 2010-066694 filed Mar. 23, 2010. The entire content of the priority application is incorporated herein by reference.

TECHNICAL FIELD

The present invention relates to an electrophotographic image forming apparatus.

BACKGROUND

There is proposed an image forming apparatus having an opening through which an exposure unit is detachably loadable. In order to realize a reduced vertical height of the image forming apparatus, the exposure unit is designed to have a thickness (height) that gradually decreases toward the opening.

SUMMARY

Recently, there has been a rise in demand for an image forming apparatus having a double-side printing function for the purpose of saving natural resources. However, in order to perform double-side printing, the conventional electrophotographic image forming apparatus requires a re-conveying unit that conveys a recording sheet discharged from a fixing unit back to a process cartridge. Therefore, the image forming apparatus inevitably necessitates a larger height, compared to an image forming apparatus without the double-side printing function.

In view of the foregoing, it is an object of the invention to provide an image forming apparatus having a reduced height but capable of performing double-side printing.

In order to attain the above and other objects, there is provided an image forming apparatus includes a transferring unit, fixing unit, a first sheet conveying path section, a re-conveying unit and a charge-removing member. The transferring unit transfers developer onto a sheet. The fixing unit fixes the developer transferred to the sheet to form a visible image on the sheet. The first sheet conveying path section extends through the transfer unit and the fixing unit, the sheet being conveyed from the transfer unit to the fixing unit along the first sheet conveying path section. The re-conveying unit constitutes a second sheet conveying path section for re-conveying the sheet from the fixing unit to an inlet side of the transfer unit, the second sheet conveying path section being positioned below the first sheet conveying path section. The charge-removing member is disposed between the first sheet conveying path section and the second sheet conveying path section, the charge-removing member constituting a part of the second sheet conveying path section and removing charges from the sheet conveyed along the first sheet conveying path section.

DETAILED DESCRIPTION

Figure 1:
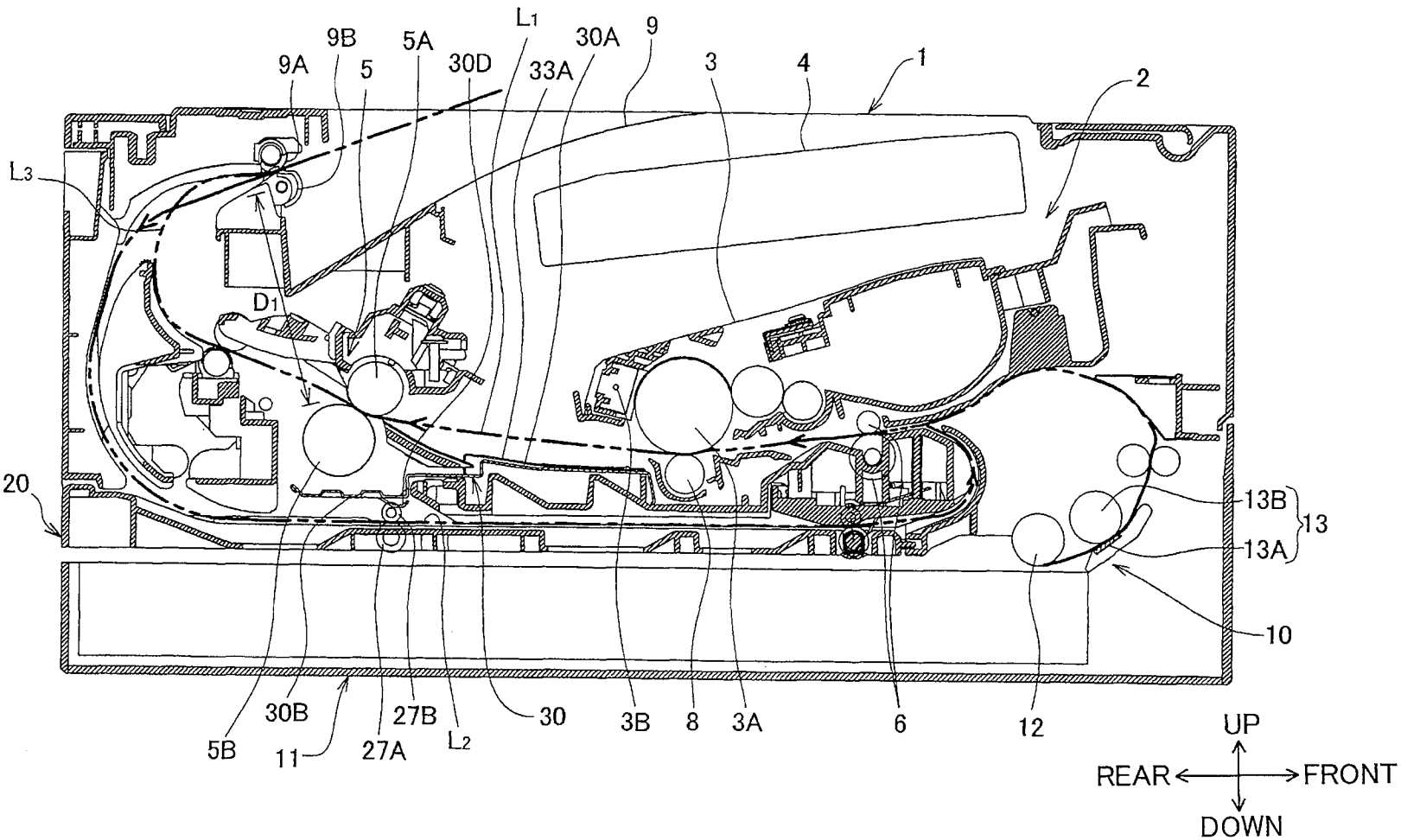
FIG. 1 is a central cross-sectional view of an image forming apparatus according to an embodiment of the present invention.

An image forming apparatus 1 according to an embodiment of the present invention will be described with reference to FIGS. 1 through 10. The terms "upward", "downward", "upper", "lower", "above", "below", "beneath", "right", "left", "front", "rear" and the like will be used throughout the description assuming that the image forming apparatus 1 is disposed in an orientation in which it is intended to be used. In use, the image forming apparatus 1 is disposed as shown in FIG. 1.

First, a general configuration of the image forming apparatus 1 will be described with reference to FIG. 1. The image forming apparatus 1 has a length in a front-to-rear direction, a width in a left-to-right direction (widthwise direction) and a height in a vertical direction.

The image forming apparatus 1 is an electrophotographic laser printer provided with a duplex (double-side) printing function. As shown in FIG. 1, the image forming apparatus 1 includes an image forming unit 2, a sheet feed unit 10, a re-conveying unit (double-side printing unit) 20 and a charge-removing member 30.

The image forming unit 2 functions to form (print) images on sheets of paper or OHP sheets (hereinafter collectively referred to as "sheets"). The image forming unit 2 includes a process cartridge 3, an exposure unit 4 and a fixing unit 5. The process cartridge 3 includes a photosensitive drum 3A on which developer is carried and a charger 3B for charging the photosensitive drum 3A.

The sheet feed unit 10 serves to convey sheets toward the image forming unit 2. The sheet feed unit 10 includes a sheet tray 11, a pick-up roller 12, a separation mechanism 13 and a pair of registration rollers 6. The sheet tray 11 accommodates therein the sheets in a stacked state. The pick-up roller 12 contacts the uppermost sheet and conveys a plurality of sheets to the separation mechanism 13. The separation mechanism 13 serves to separate the plurality of sheet conveyed from the pick-up roller 12 one by one and conveys the same to the image forming unit 2. The separation mechanism 13 includes a separation pad 13A and a separation roller 13B. The separation pad 13A applies a conveyance resistance, while the separation roller 13B applies a conveyance force to the sheets to separate the sheets from one another. The pair of registration rollers 6 is provided to correct skew of the sheets conveyed from the separation mechanism 13 toward the photosensitive drum 3A.

The photosensitive drum 3A, which is charged by the charger 3B, is exposed to light by the exposure unit 4 to form an electrostatic latent image on a surface of the photosensitive drum 3A. The developer (powder toner in the present embodiment) is then supplied to the latent image. Thus a toner image is carried on the surface of the photosensitive drum 3A.

A transfer roller 8 is disposed at a position opposing the photosensitive drum 3A so that the sheet can be nipped between the transfer roller 8 and the photosensitive drum 3A. The transfer roller 8 is applied with a charge having a polarity opposite to that of the developer (toner). Due to the charge applied to the transfer roller 8, the toner image is transferred onto the sheet as the sheet passes between the transfer roller 8 and the photosensitive drum 3A.

The fixing unit 5 functions to thermally fix the toner image onto the sheet. The fixing unit 5 includes a heat roller 5A and a pressure roller 5B. When the sheet is conveyed to the fixing unit 5 after the toner image was transferred onto the sheet, the heat roller 5A applies heat to the sheet, while the pressure roller 5B applies pressure to the heat roller 5 and the sheet.

The sheet is thus conveyed along a sheet conveying path L1 extending from the image forming unit 2 to the fixing unit 5 as indicated by a solid double-dotted chain line in FIG. 1. During passage along the sheet conveying path L1, an image is formed on one side of the sheet.

A sheet conveying path L2 is formed from the fixing unit 5 to an inlet side of the process cartridge 3 (the registration rollers 6), as indicated by a solid double-dotted chain line in FIG. 1. For performing double-side printing, the sheet that has once discharged from the fixing unit 5 after the image is formed on its one side is then conveyed along the sheet conveying path L2 so as to reach the process cartridge 3 again to form another image on other side of the sheet.

Once images are formed on both sides of the sheet, the image-formed sheet is then conveyed to a sheet conveying path L3 from the fixing unit 5, as also indicated by a solid double-dotted chain line in FIG. 1. The sheet conveying path L3 has a substantially U shape, along which the sheet is made to U-turn and is conveyed diagonally upward and frontward to be discharged onto a discharge tray 9 formed on an upper surface of the image forming apparatus 1. The sheet is thus conveyed in a sheet conveying direction, following the sheet conveying path L1, the sheet conveying path L2 and the sheet conveying path L3. In the sheet conveying direction, a widthwise of the sheet is in coincidence with the widthwise (left-to-right) direction of the image forming apparatus 1, a thickness direction of the sheet that is perpendicular to the widthwise direction of the sheet is in coincidence with the vertical direction.

A discharge roller 9A and a pinch roller 9B are provided in the vicinity of a downstream end of the sheet conveying path L3. The discharge roller 9A rotates and contacts the sheet conveyed along the sheet conveying path L3 to apply a conveyance force to the conveyed sheet. The pinch roller 9B serves to pinch the conveyed sheet in conjunction with the discharge roller 9A. In case of double-side printing, the discharge roller 9A causes the sheet (on whose one surface the image has been formed at the process cartridge 3) to turn around and directs the sheet toward the sheet conveying path L2. When image formation has ended, the discharge roller 9A simply discharges the image-formed sheet onto the discharge tray 9.

Figure 2:
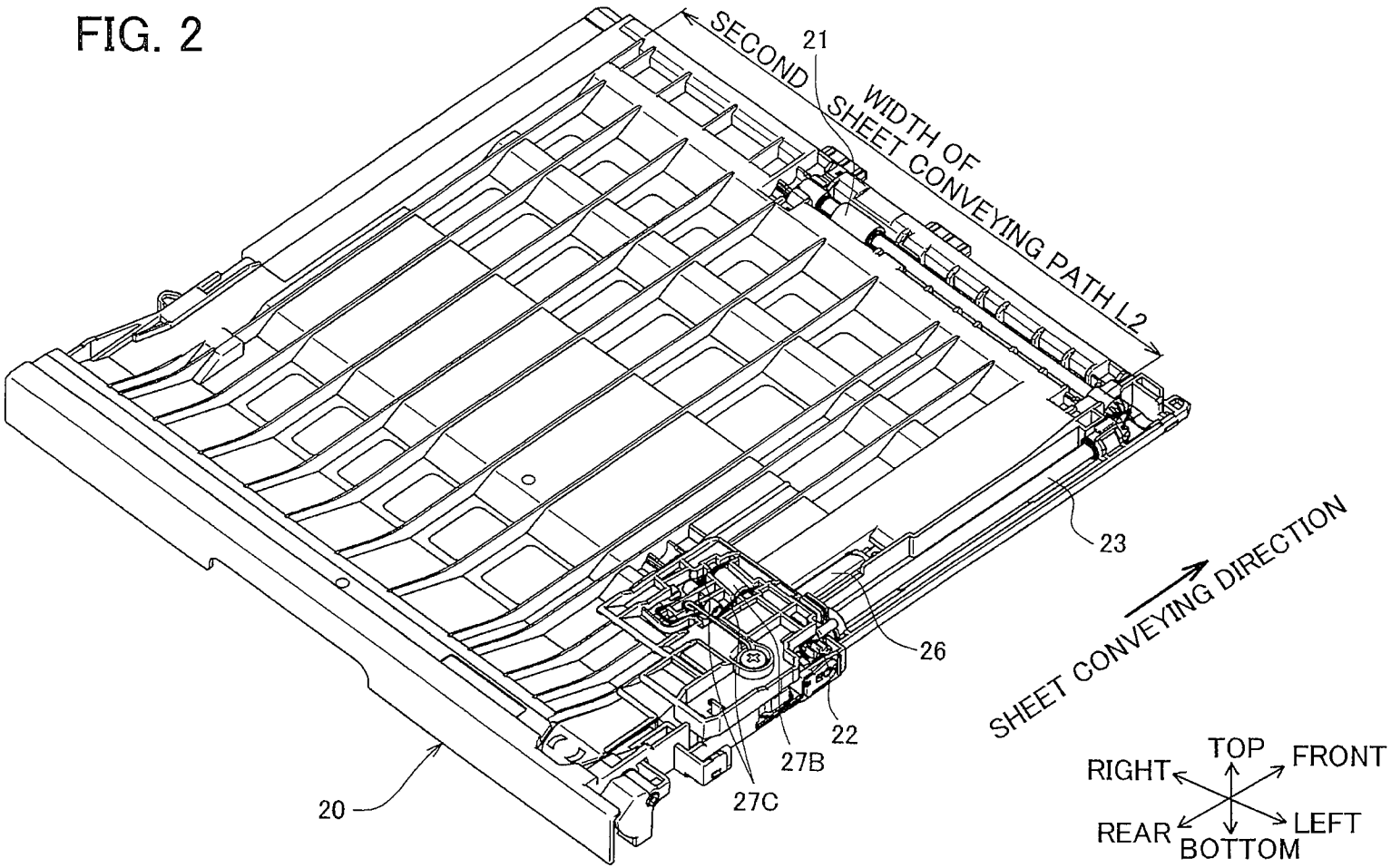
FIG. 2 is a perspective view of a re-conveying unit incorporated in the image forming apparatus according to the embodiment.
Figure 3:
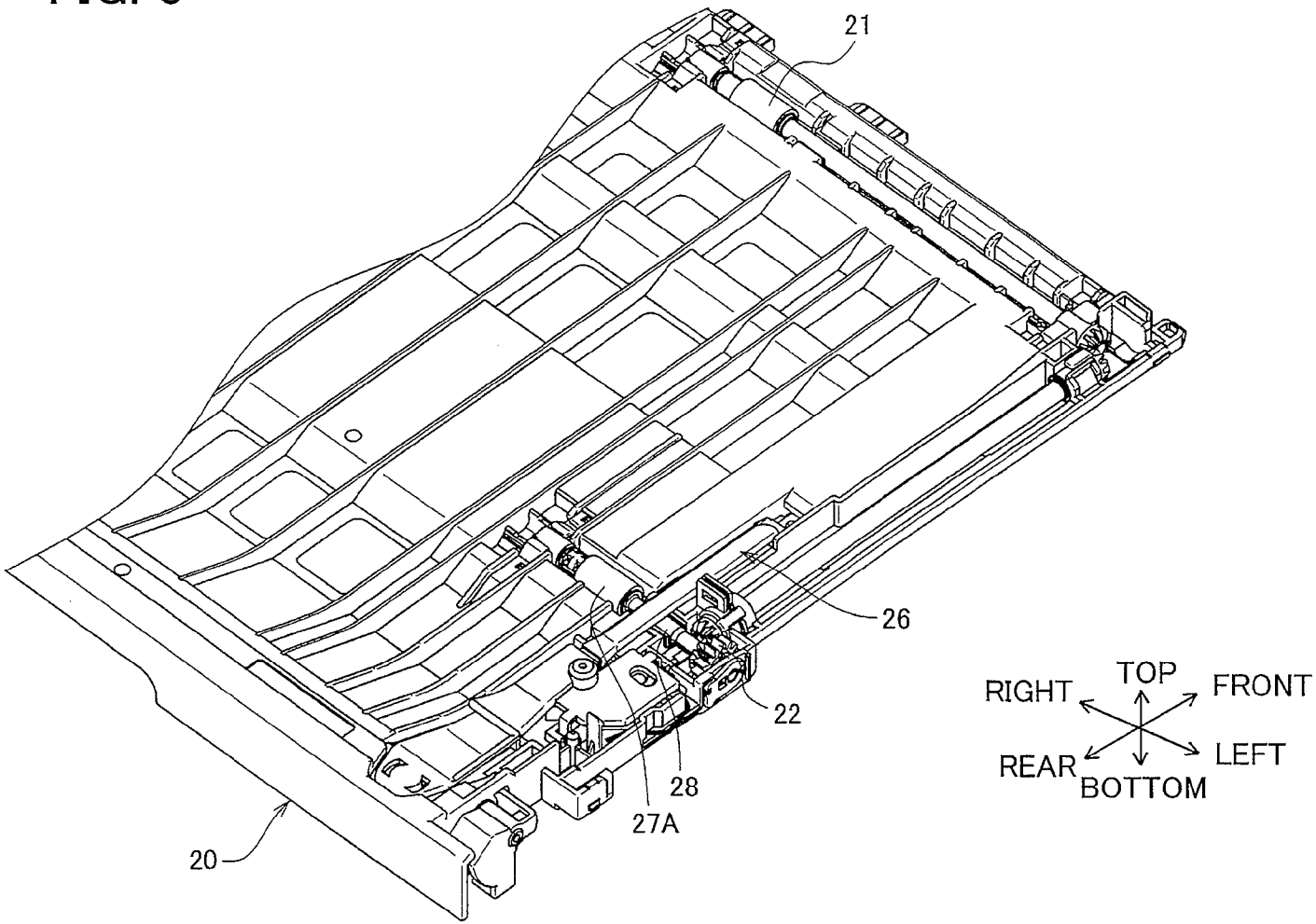
FIG. 3 is a partial perspective view of the re-conveying unit shown in FIG. 2, in which a skewed conveyor roller is removed.

The re-conveying unit 20 will now be described with reference to FIGS. 2 and 3. The re-conveying unit 20 is detachably loadable into the image forming apparatus 1 in the front-to-rear direction through an opening formed on a rear side of the image forming apparatus 1. The re-conveying unit 20 is disposed below the sheet conveying path L1 and constitutes the sheet conveying path L2. The re-conveying unit 20 includes a conveyor roller 21, an input gear 22, a first drive shaft 23, a skew conveyer roller 27B (shown in FIG. 2), a second drive shaft 28, a skew conveyer roller 27A and a skew guide 26 (shown in FIG. 3).

The conveyor roller 21 applies a conveyance force to the sheet conveyed along the sheet conveying path L2. The input gear 22 meshingly engages a drive gear (not shown) provided on a main body of the image forming apparatus 1. The first drive shaft 23 transmits a driving force supplied from the input gear 22 to the conveyor roller 21. The second drive shaft 28 is connected to the input gear 22 and transmits the driving force to the skew conveyer roller 27A.

The skew conveyer roller 27B (as a follower) is disposed in opposition to the skew conveyer roller 27A (as a driver). The skew conveyer roller 27B has a rotational shaft whose axis is slanted relative to the widthwise direction, as shown in FIG. 2. The rotational shaft of the skew conveyer roller 27B has both ends biased (pressed) toward the skew conveyer roller 27A by biasing members, such as springs 27C shown in FIG. 2. Therefore, the skew conveyer roller 27B serves to press the conveyed sheet against the skew conveyer roller 27A while rotating in conjunction with the movement of the conveyed sheet.

The skew guide 26 extends along the sheet conveying path L2 and is disposed on one side of the sheet conveying path L2 in the widthwise direction such that the skew guide 26 extends across the second drive shaft 28. Due to the skew conveyer rollers 27A, 27B, the sheet is conveyed in the sheet conveying direction (along the sheet conveying path L2) such that a widthwise end of the sheet is slidingly pressed against the skew guide 26. Therefore, even if the conveyed sheet is skewed relative to the sheet conveying direction, the skew can be corrected because the sheet is brought into contact with the skew guide 26 while being conveyed along the sheet conveying path L2.

Next, a charge-removing member 30 according to the embodiment will be described with reference to FIGS. 4 through 10.

The sheet discharged out of the process cartridge 3 is in a charged state since the photosensitive drum 3A and the transfer roller 8 are applied with high voltages for transferring the developer borne on the photosensitive drum 3A onto the sheets. The charge-removing member, 30 serves to remove charges remaining on the sheet conveyed along the sheet conveying path L1.

The charge-removing member 30 is formed of a metal and is disposed at a position between the sheet conveying path L1 and the sheet conveying path L2 in the vertical direction, as shown in FIG. 1. Although not shown, the charge-removing member 30 is electrically grounded via a power circuit.

Figure 4:
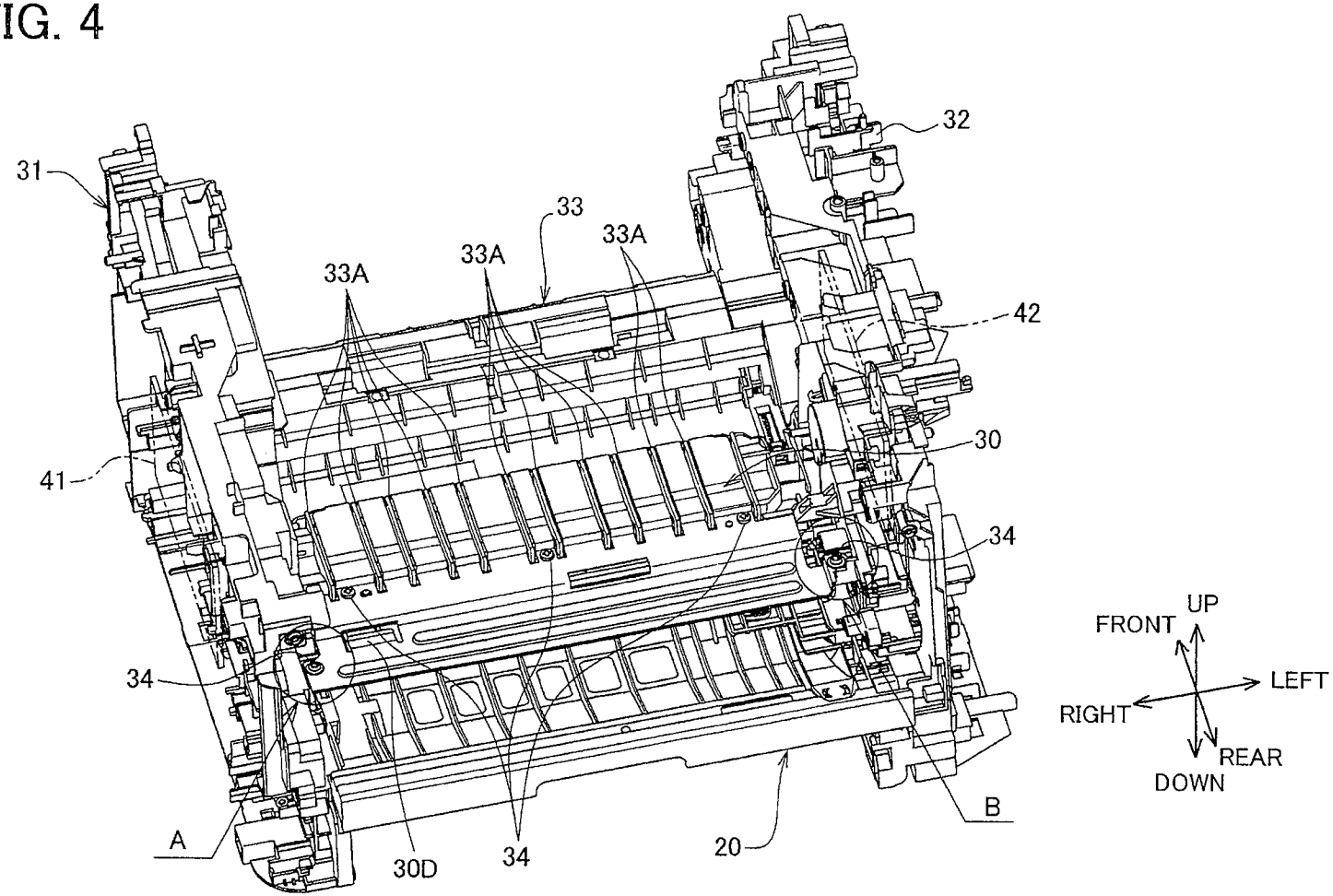
FIG. 4 is a perspective view of an assembled state of side frames, a bridge frame, the re-conveyor unit and a charge-removing member according to the embodiment.
Figure 5:
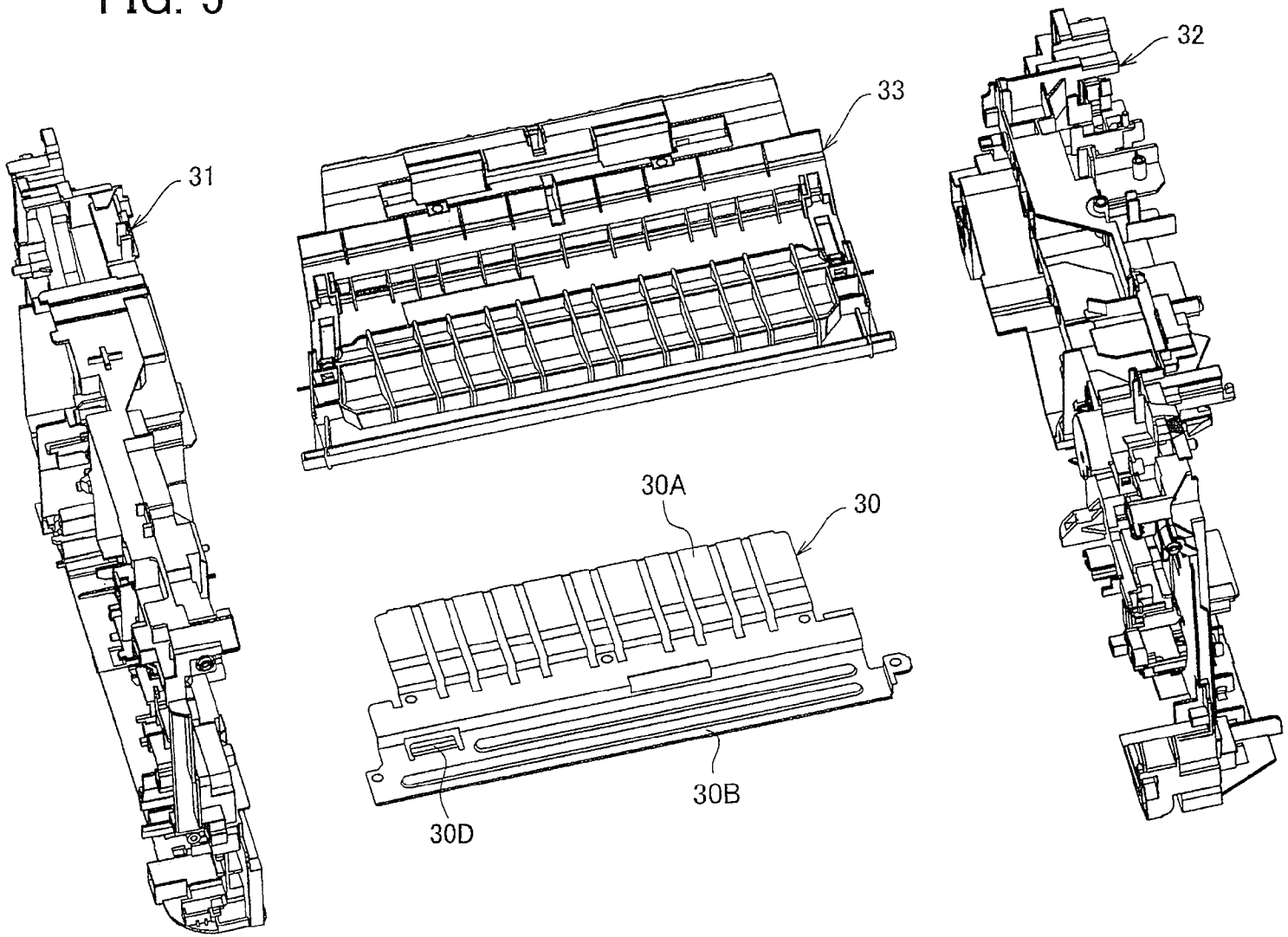
FIG. 5 is an exploded perspective view of the side frames, the bridge frame and the charge-removing member shown in FIG. 4, in which the re-conveying unit is excluded.
Figure 6:
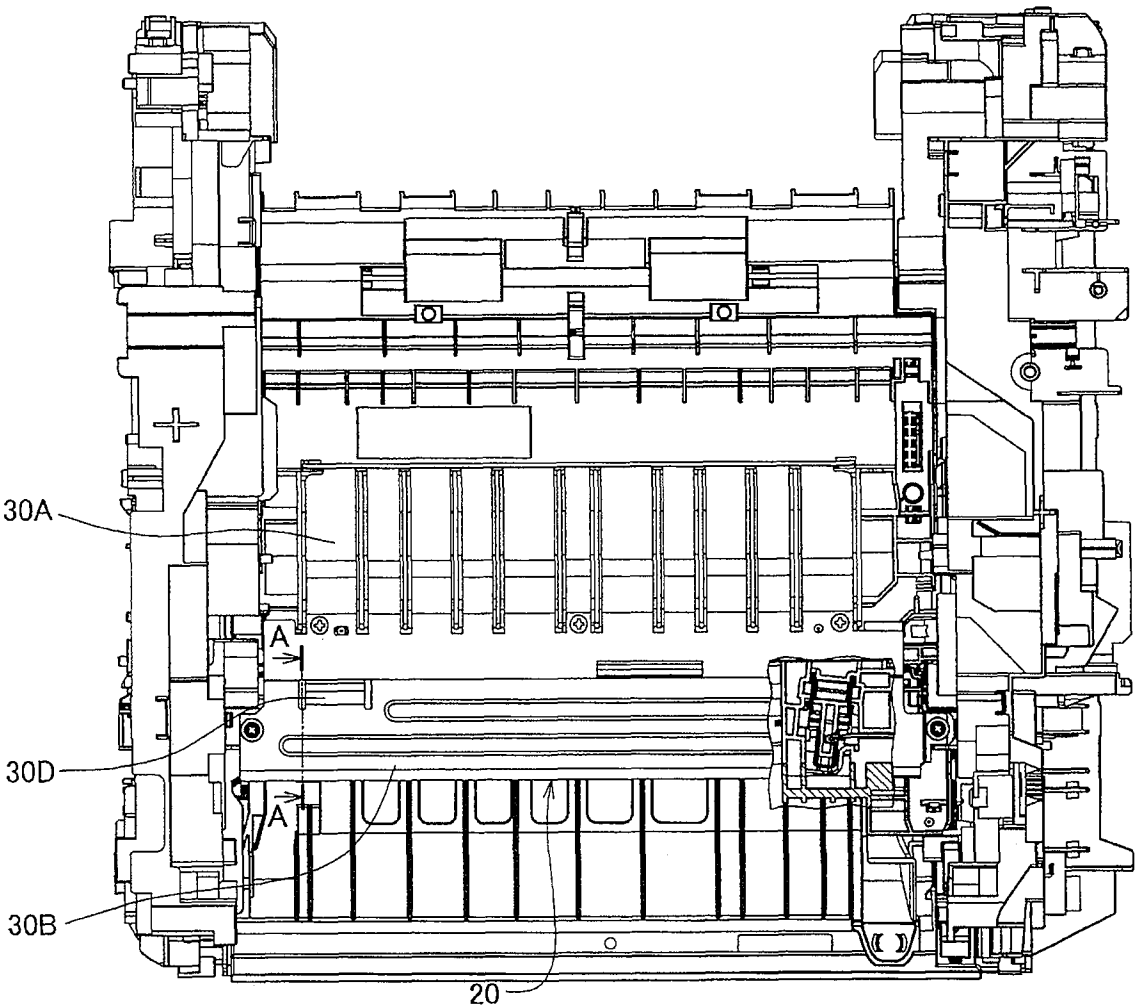
FIG. 6. is an upper side view of the side frames, the bridge frame and the charge-removing member of FIG. 4.
Figure 7:
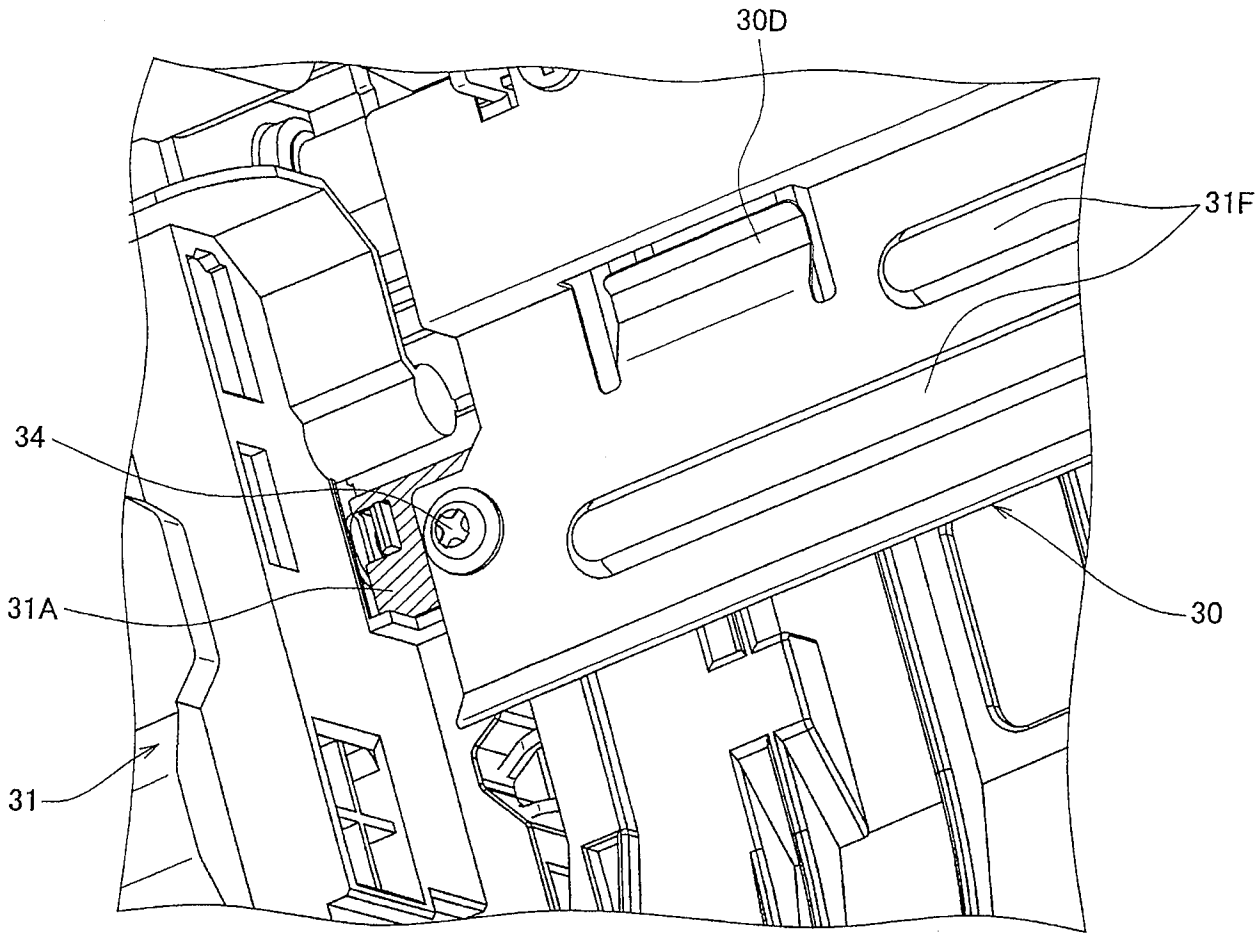
FIG. 7 is an enlarged view of an area encircled as A in FIG. 4.
Figure 8:
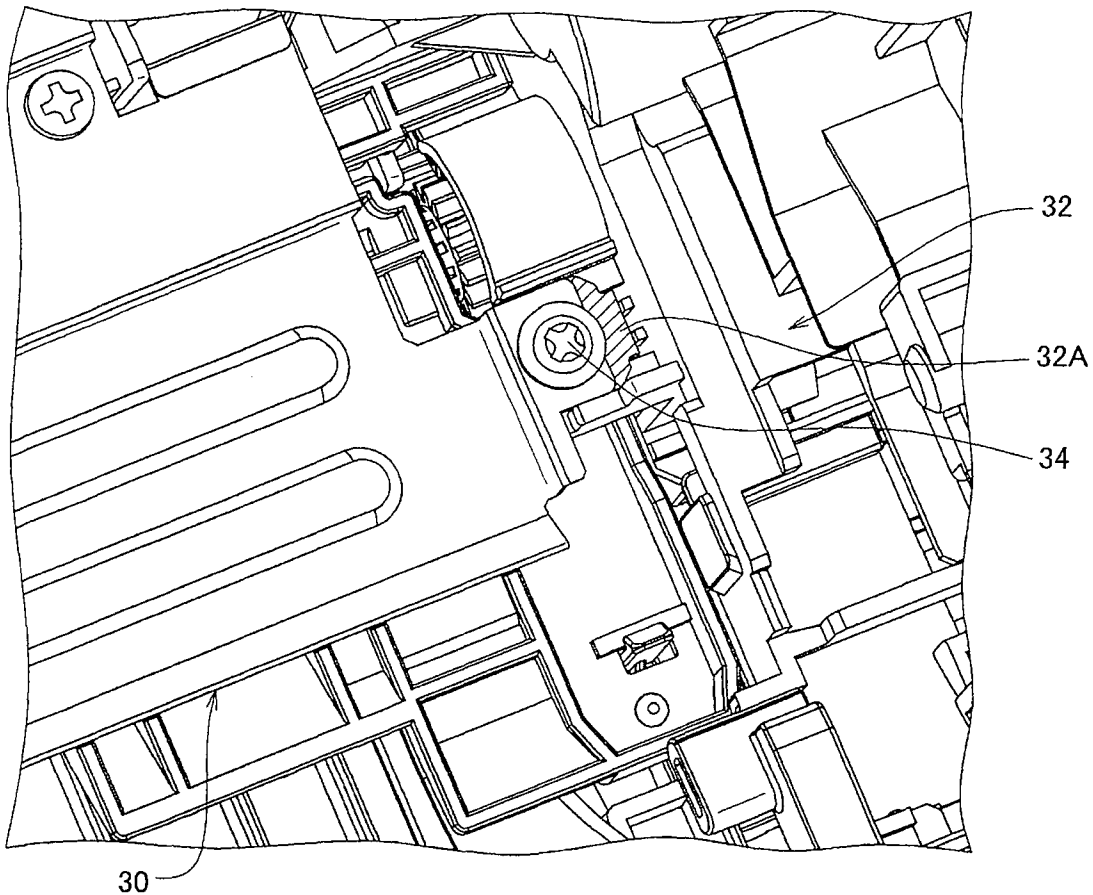
FIG. 8 is an enlarged view of an area encircled as B in FIG. 4.

The image forming apparatus 1 includes, as a structural framework to provide rigidity, side frames 31, 32 and a bridge frame 33. As shown in FIGS. 4 through 6, the side frames 31, 32 extend in the front-to-rear direction and are disposed in opposition to each other in the widthwise direction. The bridge frame 33 extends in the widthwise direction to connect the side frames 31, 32. The bridge frame 33 is fixed to the side frames 31, 32 respectively by mechanical fastening means, such as screws.

The bridge frame 33 is formed of a resin. Each of the side frames 31, 32 has a combined structure: an upper portion formed of a resin and a lower portion formed of either a metal or a resin but reinforced with a metal. Metal portions of the side frames 31, 32 are shown by hatched lines in FIGS. 7 and 8, and designated by reference numerals 31A, 32A respectively. As shown in FIG. 4, the charge-removing member 30 spans substantially across the bridge frame 33 and is connected and fixed to the metal portions 31A, 32A of the side frames 31, 32 by mechanical fastening means, such as screws 34.

Figure 9:
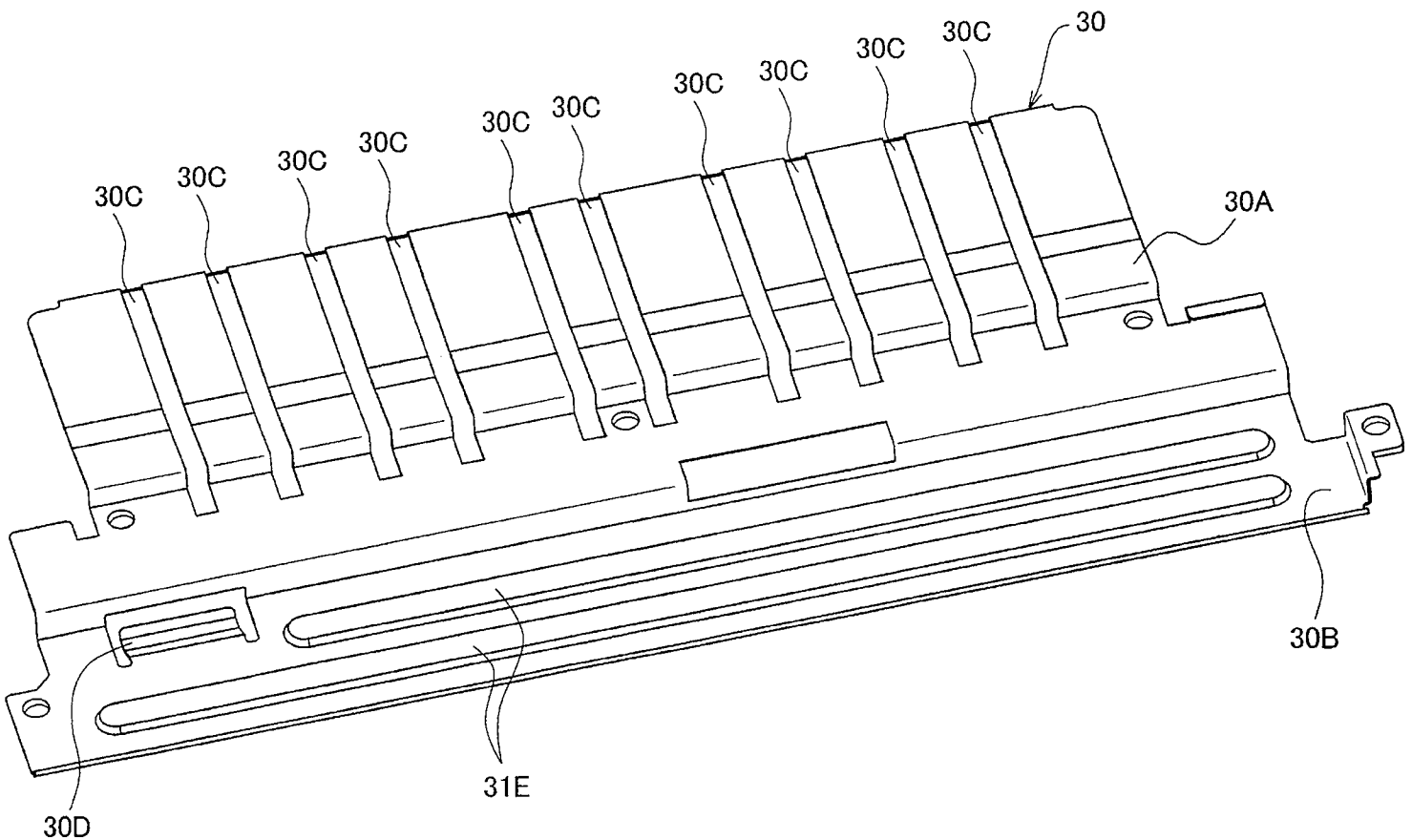
FIG. 9 is a perspective view of the charge-removing member according to the embodiment.

For fabricating the charge-removing member 30, a metal such as a steel plate subjected to cold rolling (SPCC defined in Japan Industrial Standard) is pressed into a plate-like shape, as shown in FIG. 9. The charge-removing member 30 has an upper surface that faces the sheet conveying path L1 from below (see FIG. 1). In other words, a portion of the upper surface of the charge-removing member 30 serves as a charge-removing portion 30A that removes charges from the sheets conveyed along the sheet conveying path L1. The charge-removing member 30 also has a lower surface a portion of which (30B) is exposed to the sheet conveying path L2 from above, as shown in FIG. 1. This portion 30B of the lower surface of the charge-removing member 30 constitutes a portion of the sheet conveying path L2.

The portion 30B extends rearward up to a position below the fixing unit 5 so as to cover a lower portion of the fixing unit 5. The portion 30B of the lower surface is referred to as "chute portion 30B". The charge-removing member 30 is bent in a stepped manner such that the charge-removing portion 30A is positioned higher than the chute portion 30B in the vertical direction (see FIG. 1).

As shown in FIGS. 4 to 6, the bridge frame 33 has a potion on which a plurality of guide ribs 33A is formed, the portion being coincident with the charge-removing portion 30A of the charge-removing member 30. Each guide rib 33A has an elongated-shape extending in the sheet conveying direction (the front-to-rear direction). Each guide rib 33A has a top surface aligned with one another in the widthwise direction. The top surfaces of the guide ribs 33A are adapted to abut on a lower side of the sheet to guide the sheet conveyed along the sheet conveying path L1.

The charge-removing portion 30A is formed with a plurality of slit-like through-holes 30C at positions in correspondence with the guide ribs 33A (see FIG. 9). The charge-removing portion 30A is fixed to the bridge frame 33 by the screws 34 such that each guide rib 33A penetrates through the corresponding through-hole 30C. When the charge-removing portion 30A is fixed to the bridge frame 33, the charge-removing portion 30A is positioned below the top surfaces of the guide ribs 33A, i.e., the top surfaces of the guide ribs 33A protrudes from the charge-removing portion 30A. In other words, the sheet conveyed along the sheet conveying path L1 is in contact with the top surfaces of the guide ribs 33A but in separation from the charge-removing portion 30A.

Figure 10:
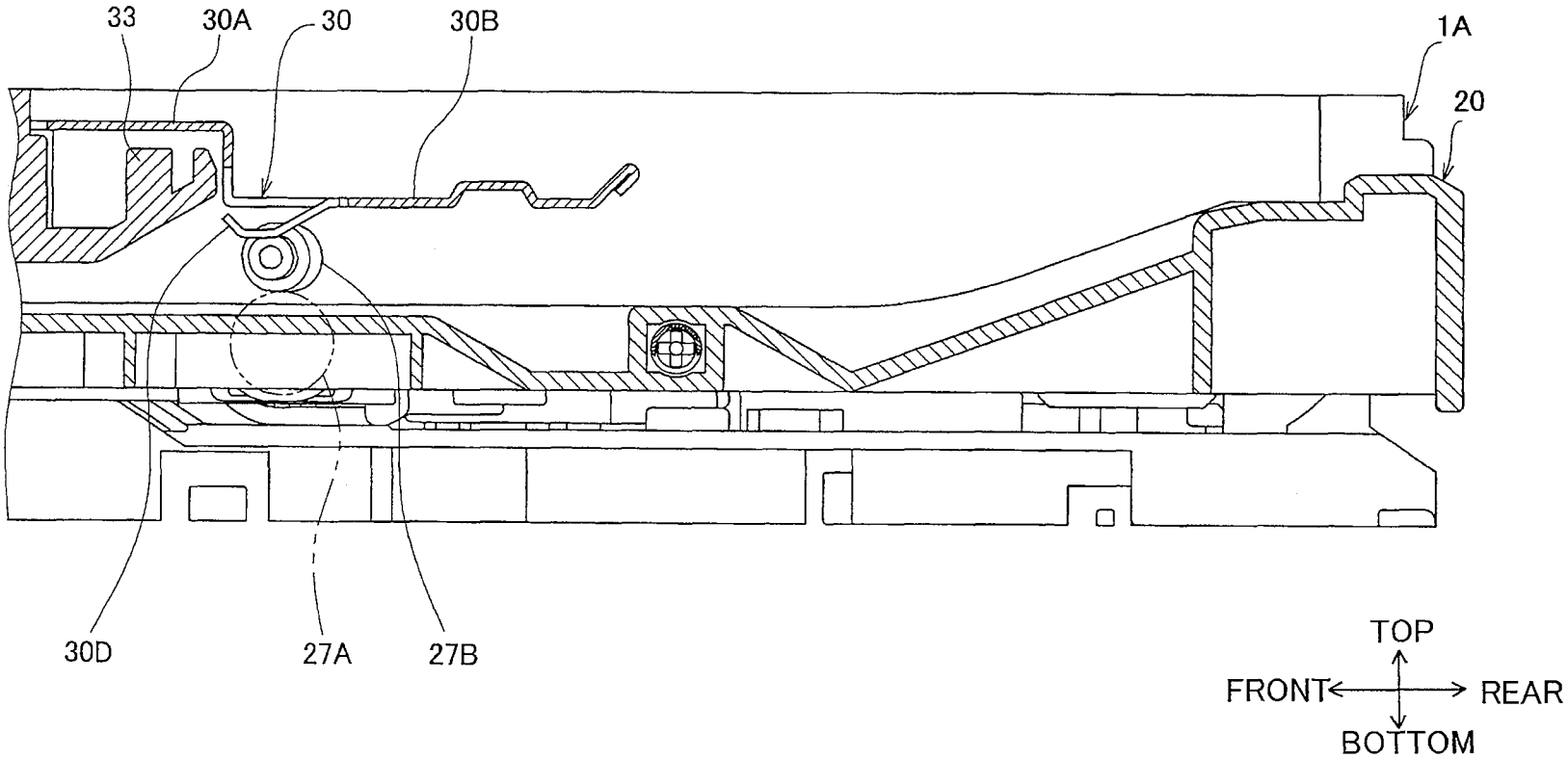
FIG. 10 is a cross-sectional view of a portion of the charge-removing member and the re-conveying unit taken along a line A-A shown in FIG. 6.

The charge-removing member 30 (the chute portion 30B) is further formed with a contact portion 30D at a position offset from the pair of skew conveyer rollers 27A, 27B with respect to the widthwise direction, as shown in FIG. 6. The contact portion 30D is a portion of the chute portion 30B that is cut and bent downward so as to protrude from the chute portion 30B, as shown in FIG. 10. The contact portion 30D is thus integrally formed with the chute portion 30B. The contact portion 30D serves to prevent the sheets conveyed along the sheet conveying path L2 from being displaced or deforming in the vertical direction.

The charge-removing member 30 is connected to the side frames 31, 32 in the widthwise direction such that widthwise ends of the chute portion 30B are connected to the metal portions 31A, 32A of the side frames 31, 32, as shown in FIG. 4. In the present embodiment, the chute portion 30B is formed with protruding portions 31E extending in the widthwise direction to enhance bending rigidity of the chute portion 30B, as shown in FIG. 9. The protruding portions 31E is formed by performing press work (such as embossing or beating) on the chute portion 30B. The contact portion 30D, the through-holes 30C and the protruding portions 31E are all formed during a single pressing process.

As shown in FIG. 4, a high-voltage electric circuit board 41 is assembled to the side frame 31 and a low-voltage electric circuit board 42 is assembled to the side frame 32. The high-voltage electric circuit board 41 applies a high voltage to the charger 3B and the like, while the low-voltage electric circuit board 42 supplies power to a drive motor (not shown) that provides driving force to various rollers. The charge-removing member 30 functions as at least a part of electric circuits for grounding the high-voltage electric circuit board 41 and the low-voltage electric circuit board 42. In other words, the high-voltage electric circuit board 41 and the low-voltage electric circuit board 42 are electrically grounded via the charge-removing member 30.

With the above-described configuration, the charge-removing member 30, which is an essential component of the image forming apparatus 1, constitutes a portion of the sheet conveying path L2. That is, any separate member for forming the sheet conveying path L2 is no longer necessary. Therefore, a number of parts to be assembled in the vertical direction can be reduced, leading to a reduced dimension of the image forming apparatus 1 in the vertical direction. Moreover, reduction in manufacturing costs of the image forming apparatus 1 can also be achieved.

Further, in the present embodiment, the charge-removing member 30 is exposed to the sheet conveying path L1 and the sheet conveying path L2. With this configuration, in case of double-side printing, charges can be reliably removed from the sheets while the sheets are conveyed along the sheet conveying path L1 and the sheet conveying path L2.

Further, the charge-removing member 30 according to the embodiment extends rearward to cover the lower portion of the fixing unit 5. The fixing unit 5 is subjected to a high temperature due to the heat applied to the developer for thermally fixing the same onto the sheets. Since the fixing unit 5 is covered with the charge-removing member 30 made of a metal whose upper temperature limit is high, the fixing unit 5 can be effectively protected.

Further, in the present embodiment, the charge-removing member 30 has the chute portion 30B that is formed to be positioned lower than the charge-removing portion 30A facing the sheet conveying path L1 in the vertical direction. This configuration allows the fixing unit 5 to be positioned lower compared to a case in which the charge-removing member 30 is formed in a simply flat shape. Therefore, in the present embodiment, the sheet conveying path L3 guiding the sheets from the fixing unit 5 to the discharge tray 9 is allowed to have a greater radius of curvature. A distance D1 between the fixing unit 5 and the discharge roller 9A (shown in FIG. 1) tends to be greater as the radius of curvature of the sheet conveying path L3 is greater. Since the sheet conveying path L3 of the present embodiment has a greater radius of curvature because of the chute portion 30B that is positioned lower than the charge-removing portion 30A, the sheets conveyed along the sheet conveying path L3 can be suppressed from being curled. Further, since the fixing unit 5 can be positioned lower within the image forming apparatus 1 due to the chute portion 30B that is positioned lower than the chute portion 30B, the image forming apparatus 1 of the present embodiment can have a reduced dimension in vertical direction, while achieving the greater radius of curvature of the sheet conveying path L3.

Note that, in FIG. 1, the distance D1 is shown as a distance between a center of the heat roller 5A and a center of the discharge roller 9A in order to facilitate understanding. A distance from the fixing unit 5 (an exit of the fixing unit 5) to the discharge roller 9A can increase as the depicted distance D1 increases.

Further, in the present embodiment, the side frames 31, 32 are provided to constitute the framework of the image forming apparatus 1. The charge-removing member 30 is fixed to the bridge frame 33 that spans between the side frames 31, 32. With this configuration, the charge-removing member 30 can serve to reinforce rigidity of the framework of the image forming apparatus 1 without providing a separate reinforcing member.

Further, the charge-removing member 30 according to the embodiment also serves to electrically ground the electric circuit boards 41, 42 which are assembled to the side frames 31, 32 respectively. With this configuration, compared to a case where a separate grounding circuit is necessitated, a number of parts can be reduced, leading to a reduction in production costs of the image forming apparatus 1.

Further, in the re-conveying unit 20 of the present embodiment, the pair of skew conveyer rollers 27A, 27B is provided to apply a conveyance force to the sheets conveyed along the sheet conveying path L2. The contact portion 30D protrudes downward from the charge-removing member 30 (the chute portion 30B) at a position offset from the pair of skew conveyer rollers 27A, 27B with respect to the widthwise direction for restricting the sheets conveyed along the sheet conveying path L2 from deforming or being displaced in the vertical direction (the thickness direction of the sheet). With this configuration, the conveyed sheets can be suppressed from being damaged or getting stuck in the sheet conveying path L2. At the same time, since the contact portion 30D is integrally formed with the charge-removing member 30, the number of parts can be reduced when compared to a case in which the contact portion 30D is provided as a separate member. Therefore, the production costs of the image forming apparatus 1 can be further reduced.

Various modifications are conceivable

For example, although the charge-removing member 30 is bent in a stepped manner such that the chute portion 30B is positioned lower than the charge-removing portion 30A in the embodiment, the configuration of the charge-removing member 30 is not limited to the above-described configuration.

The chute portion 30B is formed to cover the lower portion of the fixing unit 5 in the embodiment, but the chute portion 30B may have different configuration.

Further, the present invention is applied to the image forming apparatus 1 that is a monochromic image forming apparatus, but the present invention may be applicable to a color image forming apparatus.

While the invention has been described in detail with reference to the embodiment thereof, it would be apparent to those skilled in the art that various changes and modifications may be made therein without departing from the spirit of the invention.

What is claimed is:

1. An image forming apparatus comprising:

a transferring unit configured to transfer developer onto a sheet;

a fixing unit configured to fix the developer transferred to the sheet to form a visible image on the sheet;

a first sheet conveying path section extending through the transferring unit and the fixing unit, the sheet being conveyed from the transferring unit to the fixing unit along the first sheet conveying path section;

a re-conveying unit constituting a second sheet conveying path section for re-conveying the sheet from the fixing unit to an inlet side of the transferring unit, the second sheet conveying path section being positioned below the first sheet conveying path section; and a charge-removing member made of a single flat metal plate and fixedly disposed between the first sheet conveying path section and the second sheet conveying path section, the charge-removing member constituting a part of the second sheet conveying path section and being configured to remove charge from the sheet conveyed along the first and second sheet conveying path sections, the charge-removing member having a first surface and a second surface opposing the first surface, the first surface facing the first sheet conveying path section and being configured to remove charges from the sheet while the sheet is conveyed along the first sheet conveying path section, and the second surface facing the second sheet conveying path section to constitute the part of the second sheet conveying path section and being configured to remove charges from the sheet while the sheet is conveyed along the second sheet conveying path section.

2. The image forming apparatus as claimed in claim 1, wherein the charge-removing member has a first portion positioned below the fixing unit to cover a lower portion of the fixing unit.

3. The image forming apparatus as claimed in claim 2, further comprising:

a discharge tray disposed above the transferring unit and the fixing unit to receive the sheet formed with the visible image, a third sheet conveying path section extending from the fixing unit and upwardly directed to the discharge tray to guide the sheet from the fixing unit to the discharge tray; and a discharge roller disposed in the third sheet conveying path section and configured to apply a conveyance force to the sheet, wherein the charge-removing member has a second portion facing the first sheet conveying path section, the first portion being positioned lower than the second portion.

4. The image forming apparatus as claimed in claim 3, wherein the first portion constitutes the portion of the second sheet conveying path section.

5. The image forming apparatus as claimed in claim 1, further comprising a pair of side frames disposed in opposition to each other in a horizontal direction, the transferring unit and the fixing unit being disposed between the pair of side frames, and the charge-removing member spanning between the pair of side frames.

6. The image forming apparatus as claimed in claim 5, wherein each of the pair of side frames is provided with an electrical circuit that is electrically grounded via the charge-removing member.

7. The image forming apparatus as claimed in claim 1, wherein the sheet is conveyed along the first sheet conveying path section in a first sheet conveying direction, and the sheet formed with the visible image is conveyed along the second sheet conveying path section in a second sheet conveying direction opposite to the first sheet conveying direction, a widthwise direction being defined which is perpendicular to the second sheet conveying direction and a thickness direction of the sheet; and the image forming apparatus further comprising:

a conveyor roller that applies a conveyance force to the sheet conveyed along the second sheet conveying path section; and a contact portion protruding toward the second sheet conveying path section and positioned offset from the conveyor roller with respect to the widthwise direction to prevent deformation and displacement of the sheet running along the second sheet conveying path section.

8. The image forming apparatus as claimed in claim 7, wherein the charge-removing member has a first portion positioned below the fixing unit to cover a lower portion of the fixing unit and the contact portion protrudes downward from the first portion of the charge-removing member and is integral therewith.

9. The image forming apparatus as claimed in claim 1, further comprising a frame in which the transferring unit and the fixing unit are disposed, wherein the charge-removing member is fixed to the frame and the re-conveying unit is detachably mountable relative to the frame; and wherein the second surface of the charge-removing member faces the re-conveying unit to constitute the part of the second sheet conveying path section when the re-conveying unit is mounted in the frame.

* * * * *